United States Patent [19]

Buzzell

[11] 4,258,653

[45] Mar. 31, 1981

[54] APPARATUS FOR PREPARING A GRADIENT DYED SHEET

[75] Inventor: Harold O. Buzzell, Wollaston, Mass.

[73] Assignee: Polaroid Corporation, Cambridge, Mass.

[21] Appl. No.: 79,965

[22] Filed: Sep. 28, 1979

Related U.S. Application Data

[60] Division of Ser. No. 756,355, Jan. 3, 1977, Pat. No. 4,190,418, which is a continuation-in-part of Ser. No. 649,049, Jan. 14, 1976, abandoned.

[51] Int. Cl.[3] ..... B05C 3/04; B05C 3/12; B05D 5/06

[52] U.S. Cl. ..... 118/419; 68/175; 118/506; 427/256; 427/434.5

[58] Field of Search ..... 68/175, 205 R; 118/419, 118/420, 402, 403; 427/284, 288, 261, 265, 266, 256, 434.2, 434.5

[56] References Cited

U.S. PATENT DOCUMENTS

| | | | |
|---|---|---|---|
| 1,291,866 | 1/1919 | Harrison | 118/419 X |
| 1,943,408 | 1/1934 | Zerk | 8/150 |
| 1,968,279 | 7/1934 | Bracewell | 118/402 |
| 2,225,778 | 12/1940 | Hallman | 427/284 X |
| 2,588,973 | 3/1952 | Fitch et al. | 118/419 X |
| 2,609,269 | 9/1952 | Ryan et al. | 8/4 |
| 3,678,891 | 7/1972 | Rosenberg | 118/402 |
| 3,826,227 | 7/1974 | Allison | 118/429 |
| 3,993,435 | 11/1976 | Korver | 118/425 |

*Primary Examiner*—Morris Kaplan
*Attorney, Agent, or Firm*—Louis G. Xiarhos

[57] ABSTRACT

Means orient a web to lie in a vertical plane and feed the web longitudinally through a dye bath in a generally horizontal path and with progressive transverse immersion and emersion. Reciprocating paddle means produce a wave form to the bath surface.

7 Claims, 3 Drawing Figures

APPARATUS FOR PREPARING A GRADIENT DYED SHEET

This is a division of application Ser. No. 756,355, filed Jan. 3, 1977, now U.S. Pat. No. 4,190,418, which is a continuation-in-part of application Ser. No. 649,049, filed Jan. 14, 1976, now abandoned.

BACKGROUND OF THE INVENTION

This invention relates to apparatus for applying dyes to webs so as to obtain a smoothly changing gradation in the amount of dye present on the web as a function of the distance from a specified edge.

There are currently commercially available glass lenses which have been dyed with a gradation in shade from a deep hue, generally at the top of a lens, vignetting to a very light hue as the dye area nears the bottom of the lens. The lenses for such sunglasses are usually prepared by dipping each lens slowly into a dye material and removing the lens so dipped. The result of this individual dipping is a differential dyeing as a function of the residence time of each lens in the dye solution, but the process is a slow and expensive one.

The object of this invention is to provide a means for the continuous production of a web material having a predetermined dye density gradient. The web may be cut into sunglass lenses after the dyeing process.

Another object is to provide the means for assuring a requisite differential residence time in the dye bath without introducing striations which mark the limit of dye contact.

A still further object is to provide apparatus useful in the continuous preparation of a web with a dye density gradient.

Other objects of the invention will in part be obvious and will in part appear hereinafter.

The invention accordingly comprises the apparatus possessing the construction, combination of elements and arrangement of parts which are exemplified in the following detailed disclosure.

SUMMARY OF THE INVENTION

This invention is concerned with apparatus for dyeing a web in a continuous manner so as to impart a dye density gradient to the web across the narrow, or transverse dimension of the web. The web so dyed may then be cut into lens blanks.

BRIEF DESCRIPTION OF THE DRAWINGS

For a fuller understanding of the nature and objects of the invention, reference should be had to the following detailed description taken in connection with the accompanying drawing wherein.

DESCRIPTION OF THE PREFERRED EMBODIMENTS

Figure 1:
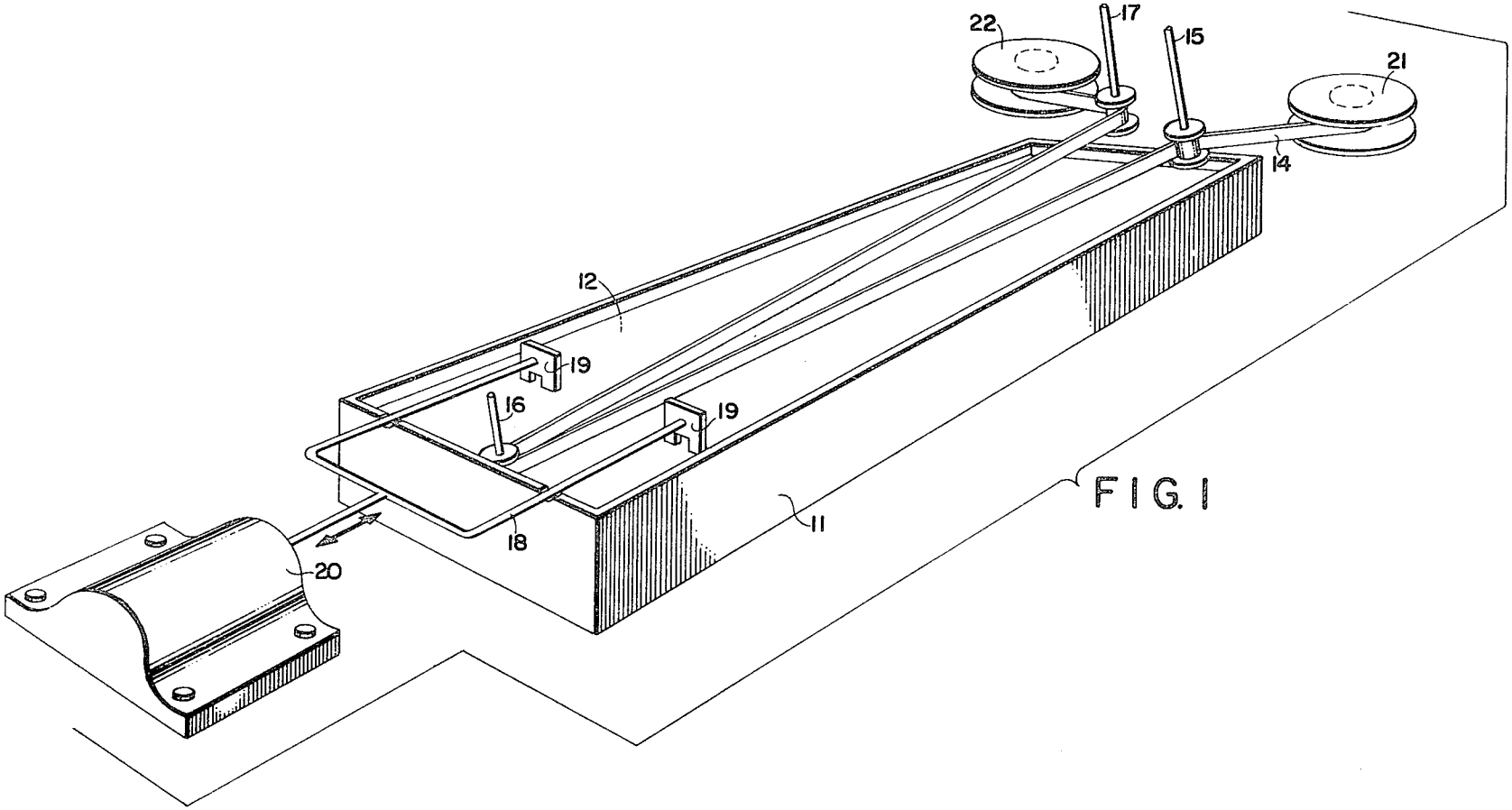
FIG. 1 is a perspective view of an apparatus for providing a dye density gradient to a web in accordance with this invention.

Referring to FIG. 1, the apparatus of the instant invention, which generally comprises a dye bath container and associated web-transport equipment is depicted.

Dye bath container 11, which is adapted to retain dye bath 12, is associated with means for conducting a web 14 longitudinally into dye bath container 11, and progressively transversely submerging the web 14 into the dye bath 12, and conducting the web 14 out of dye bath 12. These conducting means generally comprise adjustable pulleys 15, 16 and 17. There is also shown means for producing waves on the surface of the dye bath. Such wave-producing means comprise a frame 18, paddles 19 attached to the frame 18, and means 20 attached to the frame 18 for moving the frame 18 and attached paddles 19 in a reciprocating manner. The dye bath container may be associated with heating means (not shown). The dye bath material itself comprises either a solution or dispersion of a dye which may be, for example, a water-soluble dye in a water solution, an organic solvent-soluble dye in, for example, an alcohol-water mixture, or preferably a water dispersible dye dispersed in water. A preferred dye is one which is absorbed by the web only at a temperature above about 180° F. which obviates the possibility of unintentionally staining the web by random spattering of cool dye onto the web. A preferred dye is the dispersion sold as a "catalytic dye" by Brainpower Inc. of Florida although other dispersions, such as the commercially available Rit dyes may be used.

The web 14 preferably comprises a continuous flexible sheet of material having a transverse, or widthwise dimension small relative to its longitudinal, or lengthwise dimension. The top and bottom edges are substantially parallel. In a preferred embodiment the transverse dimension may be, for example, approximately 5 to 10 cm while the longitudinal dimension, may be several hundred meters. Preferably this flexible web will comprise a transparent synthetic plastic material and will be initially provided on a supply spool 21, threaded through the conducting or transport means and onto the take-up spool 22.

Figure 2:
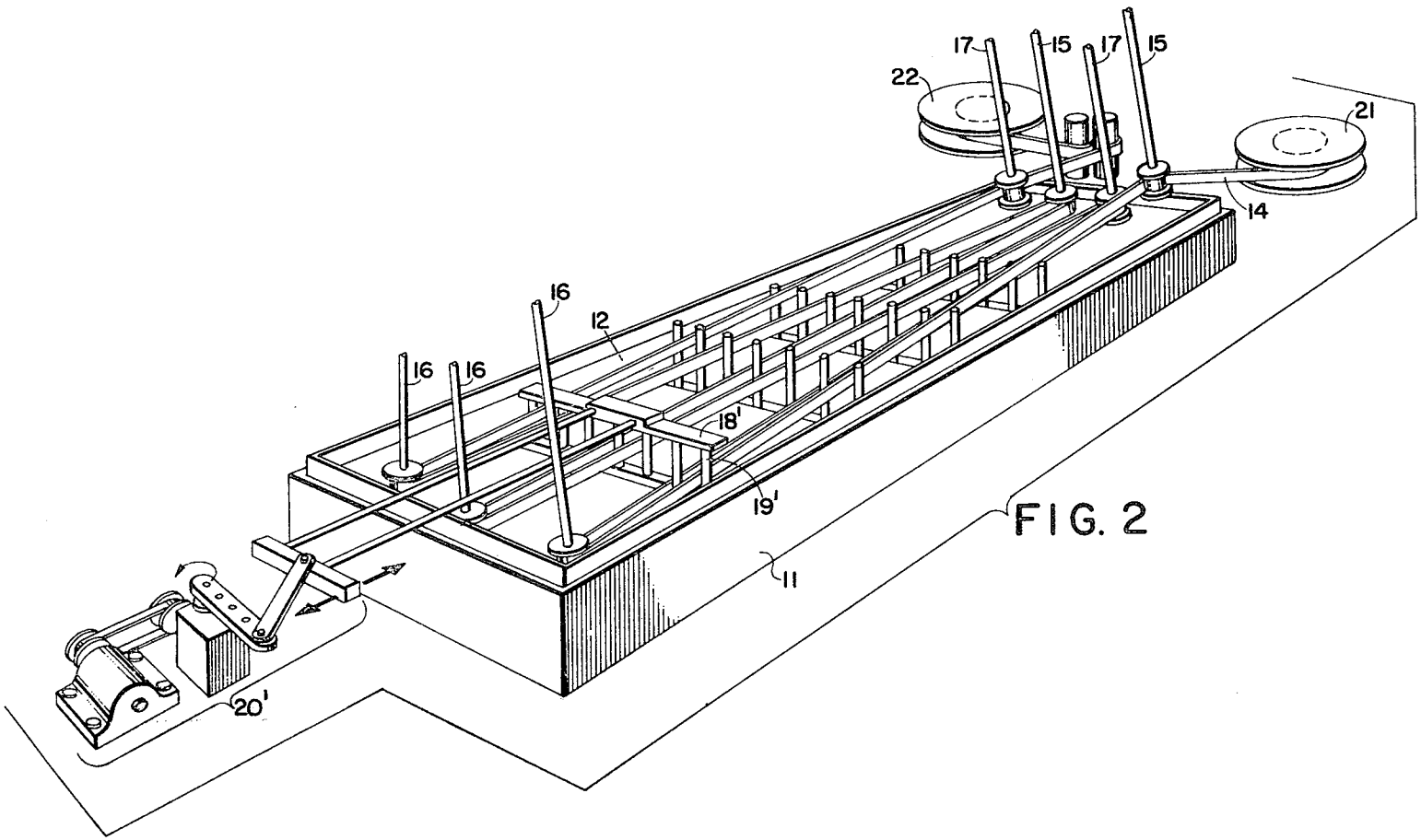
FIG. 2 is a perspective view of another embodiment of the apparatus of this invention.

FIG. 2 shows the preferred embodiment of the apparatus of the present invention wherein additional adjustable transport means conduct the web progressively transversely into and out of the dye bath three times before conducting the webs onto the take-up spool 22. Obviously the intensity gradient of the dyeing may be controlled by precisely adjusting the residence times of progressive transverse points of the web in the dye bath.

In operation a spool containing a web of material to be dyed is fixed in a position adjacent the dye bath 12 such that a plane through longitudinal dimension of the web as it enters the dye bath is preferably substantially perpendicular to the surface of the bath and the top and bottom edges of the web are at a small acute angle to the surface of the dye bath. This orientation results in the bottom edge of the web being progressively immersed into the bath as the web proceeds from the spool and then progressively emersed from the bath so that a differential transverse residence time is established for the web in the dye bath. This operation essentially comprises conducting the web progressively, transversely into the dye bath to a point of maximum submersion, then conducting the web out of the dye bath. Dye which adheres to, but is not absorbed by the web can be easily washed from the surface of the web before drying and winding.

Figure 3:
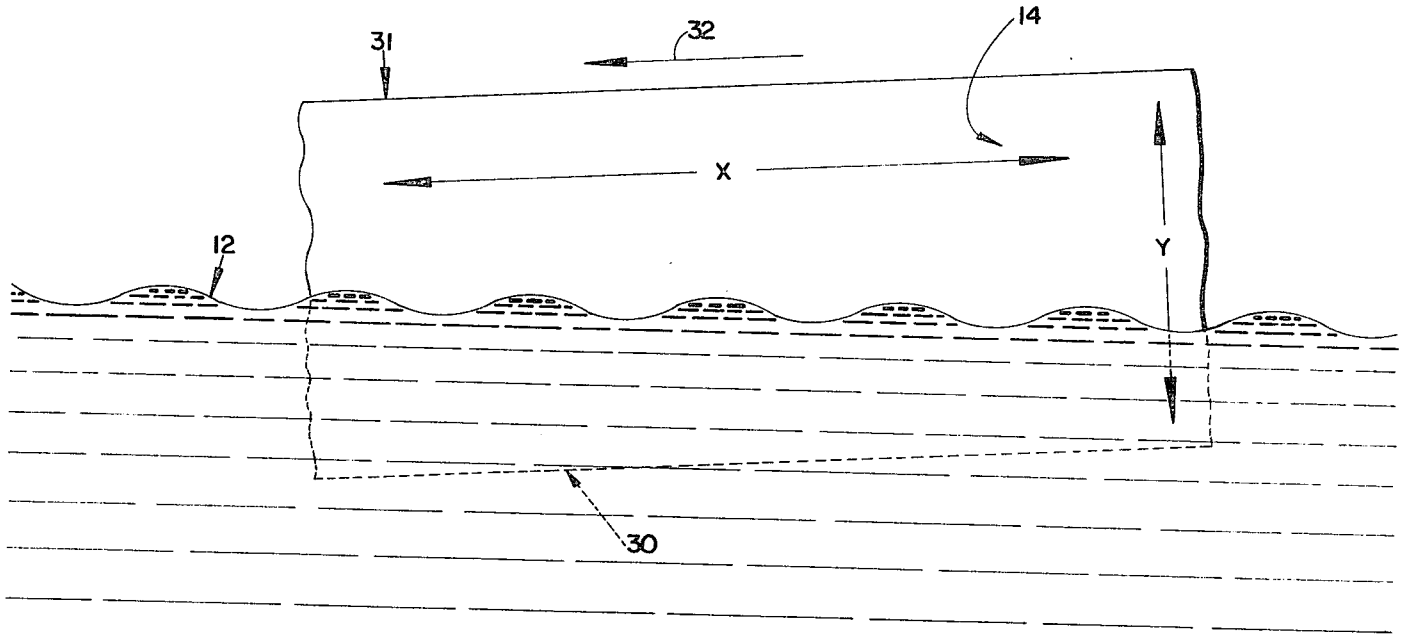
FIG. 3 is a side view of a section of the web as it enters the dye bath.

Referring to FIG. 3, there is depicted a side view of a section of web 14 entering dye bath 12 in the direction indicated by the arrow marked 32. The bottom edge 30 of the web enters the dye bath at an angle acute to the average surface of the dye bath. Top edge 31 is essentially parallel to bottom edge. It can be seen that those points on the web nearer the bottom edge have a longer residence time in the dye bath than do those points further away from the bottom edge, closer to the top edge. X and Y denote, respectively, the longitudinal and transverse dimensions of the web.

Preferably the dye bath will contain up to about 25 % of a water miscible solvent having a low vapor pressure such as, for example, ethylene glycol, which will keep the dye from crystallizing on the surface of the web so that excess, unabsorbed dye may be washed off. A preferred concentration of ethylene glycol is approximately ten per cent by volume.

The amount of dyeing at any point in the web is directly related to the time of exposure of that point to the dye bath material in the dye bath container, i.e., the residence time of that point in the bath. For a given transverse segment, those points exposed to the dye bath for a longer residence time, that is, those points first submerged into the dye bath and last removed from the dye bath, have a greater exposure to the dyeing material and have more dye absorbed than those points having a shorter residence time. The progression of points on a given transverse segment, starting at one edge of that segment and moving to the other edge with the residence time varying constantly from one point to the next will result in a dye density gradient on that transverse segment.

The web, after the dyeing, will then have excess liquid removed from its surfaces by, for example, a squegee. The dyed web may then be washed, dried and rolled in conventional manner.

As stated above the web may comprise a transparent synthetic plastic material such as oriented polyvinyl alcohol which is commonly used in the manufacture of sunglass lenses, though any suitable synthetic plastic web material may be used. The web of the preferred embodiment comprises a sheet of a plastic laminate comprising the following layers in sequence: a layer of polymerized polyethylene glycol dimethacrylate, a layer of cellulose acetate butyrate, a polarizing layer comprising an iodine-stained, molecularly oriented polyvinyl alcohol, a second layer of cellulose acetate butyrate and a second layer of polymerized polyethylene glycol dimethacrylate.

The washed, dried, dyed web may be cut into lens blanks so that the dye density gradient, which is transverse with respect to the web, runs from what may be designated as the top of a sunglass lens to the bottom of such a lens.

It is important in producing a dye density gradient on the web that a smooth gradient is obtained and therefore it is important that there be introduced no striations indicating an abrupt change in density. Such striations can be avoided by disturbing the surface of the dye bath, for example, by creating waves on the surface. These waves may be formed, for example, by paddles 19 attached to means for moving said paddle back and forth in the dye bath. Such means are shown in the figures as the frame 18 and means 20 for moving the frame in a reciprocating manner. The waves, so set up, introduce a constantly changing but random surface configuration and make possible the avoidance of formation of the striations which might be introduced and destroy the smooth gradient.

Since certain changes may be made in the above apparatus without departing from the scope of the invention herein involved, it is intended that all matter contained in the above description and shown in the accompanying drawings shall be interpreted as illustrative and not in a limiting sense.

What is claimed is:

1. Apparatus for providing a dye density gradient to a web which comprises:

(a) a container adapted to retain a dye bath, (b) supply means and take up means to said web associated with said container, (c) means associated with said container for continually conducting said web longitudinally into said dye bath container and progressively transversely submerging said web in said dye bath, and (d) means associated with said container for conducting said web out of said dye bath.

2. The apparatus of claim 1 which further comprises means associated with said dye bath container for agitating the surface of a dye bath retained in said container.

3. The apparatus of claim 2 wherein said wave producing means comprise a frame for paddles, a plurality of paddles attached to said frame and means attached to said frame for moving said frame and said paddles in a reciprocating manner.

4. The apparatus of claim 1 which further comprises means for heating said dye bath associated with said container.

5. The apparatus of claim 1 wherein said means for continually conducting said web comprise a plurality of adjustable pulleys.

6. Apparatus for providing a dye density gradient to a web which comprises:

(a) a dye bath container adapted to retain a dye bath, (b) means associated with said dye bath container for producing waves on the surface of dye bath retained in said container, said means comprising a frame for paddles, a plurality of paddles attached to said frame and means attached to said frame for moving said frame and said paddles in a reciprocating manner, (c) means associated with said dye bath container comprising a plurality of adjustable pulleys for conducting said web longitudinally at an angle to said surface of said dye bath into said dye bath container and progressively transversely submerging said web in said dye bath, and (d) means associated with said container for conducting said web out of said dye bath.

7. The apparatus of claim 6 which further comprises heating means associated with said dye bath.

* * * * *